US005465809A

United States Patent [19]

Panicci

[11] Patent Number: 5,465,809

[45] Date of Patent: Nov. 14, 1995

[54] SAFETY PLATFORM ATTACHMENT APPARATUS

[76] Inventor: Richard L. Panicci, 30 Cedar St., Hanover, Mass. 02339

[21] Appl. No.: 287,304

[22] Filed: Aug. 8, 1994

[51] Int. Cl.[6] ..... E06C 7/16

[52] U.S. Cl. ..... 182/121; 248/238

[58] Field of Search ..... 182/120–122; 248/221.4, 221.3, 215, 340, 238

[56] References Cited

U.S. PATENT DOCUMENTS

| | | | |
|---|---|---|---|
| 3,067,836 | 12/1962 | Carnicelli | 182/121 |
| 4,034,902 | 7/1977 | Grillo | 248/340 |
| 4,085,819 | 4/1978 | Ohnstad . | |
| 4,401,187 | 8/1983 | Van Patten . | |
| 4,482,030 | 11/1984 | Lincourt . | |
| 4,911,265 | 3/1990 | Skaggs . | |
| 4,953,661 | 9/1990 | Hilton et al. . | |
| 4,972,923 | 11/1990 | Krause | 182/121 |
| 5,052,515 | 10/1991 | Nowlan . | |
| 5,072,808 | 12/1991 | Spalt et al. . | |
| 5,080,310 | 1/1992 | Choi | 248/221.3 |

*Primary Examiner*—Alvin C. Chin-Shue

[57] ABSTRACT

A safety platform attachment (10) for ladders is shown having an expanded treaded platform (24) and mirror image torque arms (12, 14) for attachment thereto. Torque arms (12, 14) each have upper and lower ladder rung receiving seats (34, 38; 36, 40) and a plurality of automatically self adjusting locks (42) which hold the safety platform attachment securely in place on the ladder and prevent accidental dislodgement.

15 Claims, 4 Drawing Sheets

SAFETY PLATFORM ATTACHMENT APPARATUS

BACKGROUND OF THE INVENTION

This invention relates generally to a safety platform attachment apparatus for ladders and more specifically to a safety platform attachment which may be easily and securely attached to the rungs of a ladder and easily detached therefrom without the use of any tools.

It is well known that standing on a single, narrow rung of conventional wooden or metal ladders for even a short time causes discomfort, fatigue and strain in one's musculature. This is due to the very small surface area generally provided by ladder rungs on which to stand. Even the use of generally "D" shaped or triangular shaped rungs, as opposed to circular rungs, does not provide enough area to eliminate the problem. Further, the widespread popularity of footware incorporating a soft or elastomeric material for the sole of such footware exacerbates the problem.

Although there have been many attempts to solve this problem they have all suffered from various shortcomings, generally by being too complex and expensive for wide spread use.

SUMMARY OF THE INVENTION

Accordingly it is an object of the invention to provide a safety platform attachment apparatus which has a sufficiently robust construction to safely and comfortably support a user's weight and which can be easily attached to and detached from a ladder without the use of any tools.

Another object of the invention is to provide adequate, increased tread surface area in order to reduce muscle fatigue and strain thereby promoting safety.

Yet another object is the provision of such apparatus in which the structure for attachment is intrinsic and self adjusting for a variety of ladder rung shapes and sizes and therefore besides providing secure attachment also eliminating the possibility of generating disconserting rattling noises against the ladder rungs.

Still another object of the invention is the provision of a safety platform attachment which can be easily and inexpensively manufactured.

Briefly, in accordance with the invention, a safety platform attachment apparatus for ladders comprises first and second torque arms each having an upper and a lower terminus portion and having a platform of expanded tread surface fixedly attached and extending between the arms at the lower terminus portions thereof. A ladder rung receiving seat is formed at the upper and lower terminus portions of each torque arm, the seats being generally U-shaped and opening in a downwardly facing direction. Locking means comprising a pair of flexible ears extend from each leg of the U-shaped seat of the torque arms toward one another and preferably each is angled inwardly toward the center of the apparatus. The outer free distal end of the ears are preferably spaced from one another a distance less than the thickness of the rung of a ladder. According to a feature of the invention the spacing between the upper and lower locking means is essentially the same as the distance between adjacent rungs of a standard ladder. Preferably the distance between the locking means and the bight portion of the U-shaped seat of the upper portion is slightly greater than the distance between the locking means and the bight portion of the lower portion to ensure stable mounting of the tread portion by engagement of the bight portion of the lower locking means on a ladder rung.

According to a feature of the invention a projection is formed extending rearwardly from each torque arm intermediate the upper and lower terminus portions to serve as a stop surface adapted to engage the lower surface of a rung and prevent uncontrolled motion upon detaching the apparatus therefrom.

The invention accordingly comprises the constructions hereinafter described, the scope of the invention being indicated in the appended claims.

BRIEF DESCRIPTION OF THE DRAWINGS

Other objects, advantages and details of the novel and improved safety platform attachment apparatus of the invention appear in the following detailed description of the preferred embodiment of the invention, the detailed description referring to the drawings in which.

DETAILED DESCRIPTION OF THE PREFERRED EMBODIMENT

Figure 1:
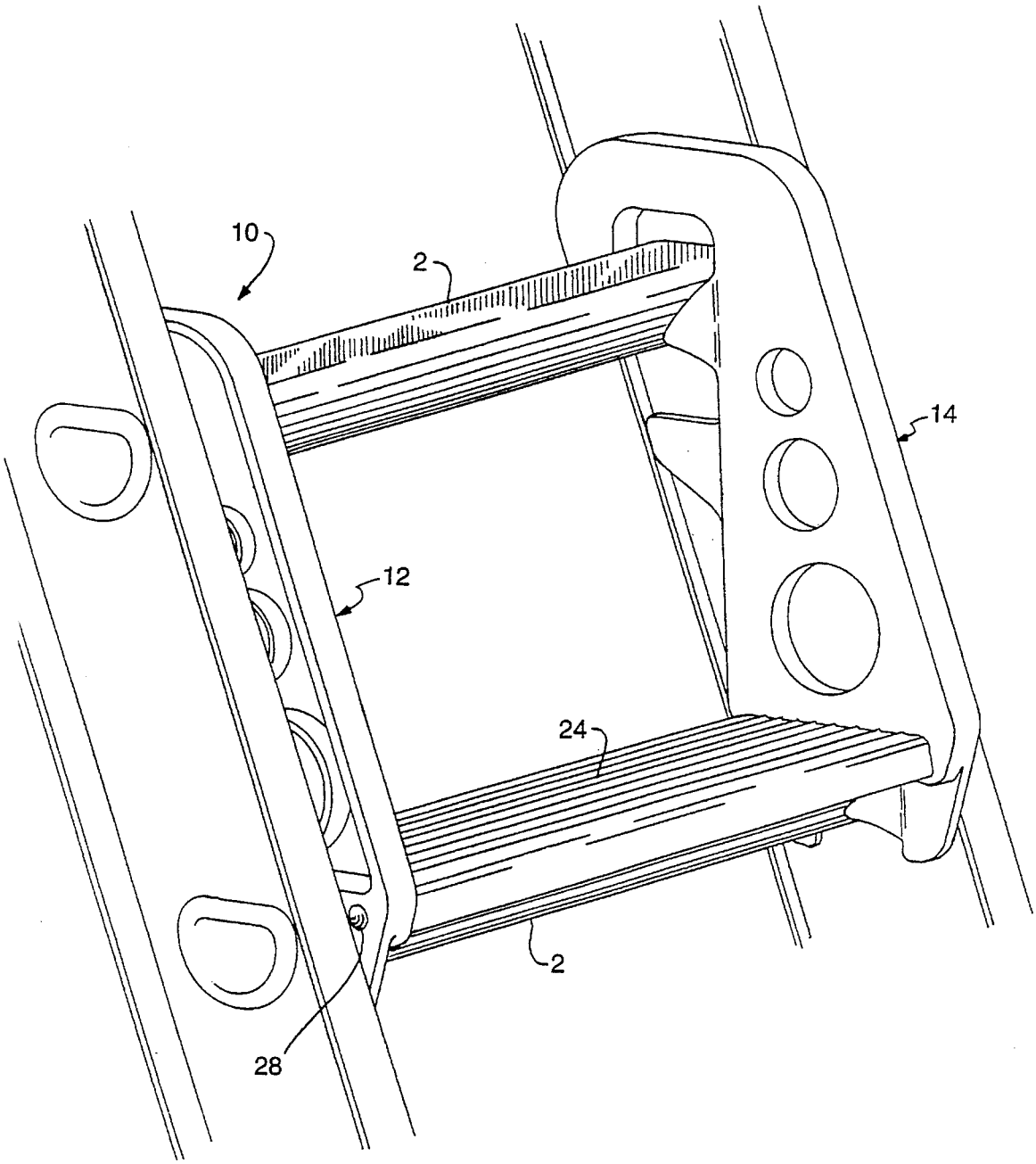
FIG. 1 is a perspective view of a safety platform attachment apparatus for a ladder made in accordance with the invention and shown mounted on a ladder, broken away, at its fully seated position.
Figure 2:
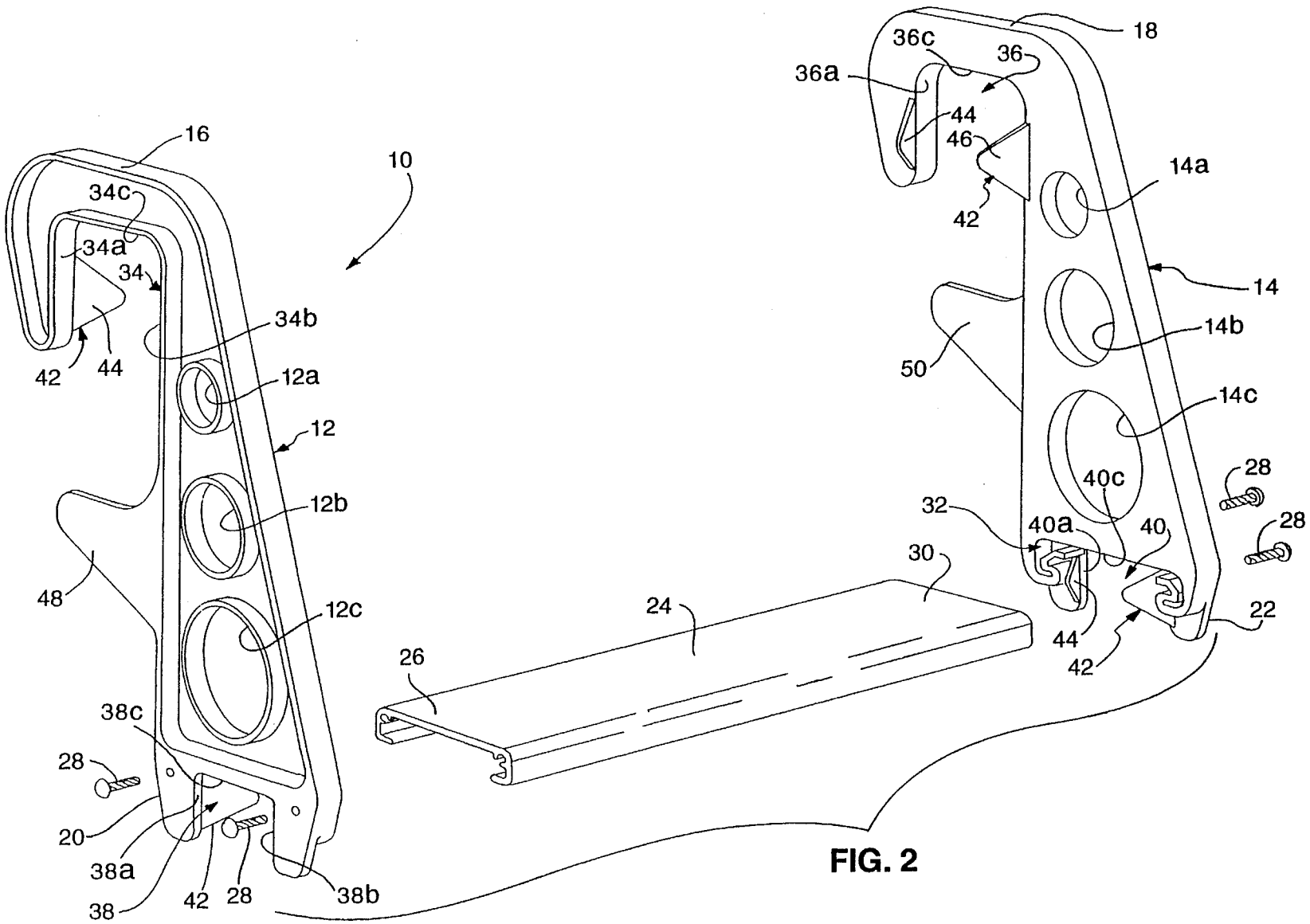
FIG. 2 is an exploded perspective of the FIG. 1 attachment apparatus.

With reference to FIGS. 1 and 2, a safety platform attachment apparatus 10 for ladders made in accordance with the invention comprises first and second mirror image torque arms 12, 14 having respective upper terminus portions 16, 18 and lower terminus portions 20, 22. A laterally extending generally rectangular tread or platform member 24 having an expanded top surface has a first end 26 rigidly and fixedly attached to lower terminus portion 20 of torque arm 13 at a recessed seat (not shown) using conventional fasteners such as screws 28 and a second end 30 similarly attached to lower terminus portion 22 of torque arm 14 at recessed seat 32. A suitable tread surface is provided on platform member 24, as shown in FIG. 1, to obtain a non-slippery interface for a person using the apparatus.

Respective rung receiving seats 34, 36, generally having an inverted U-shape having opposed legs 34*a*, 34*b* and 36*a*, 36*b* joined by bight portions 34*c*, 36*c* respectively, and opening in a downward direction are disposed at upper terminus portions 16, 18 and corresponding respective openings 38, 40 are disposed at lower terminus portions 20, 22. Inverted U-shaped seats 38, 40 have respective opposed legs 38*a*, 38*b* and 40*a*, 40*b* joined by bight portions 38*c*, 40*c* respectively. Each rung receiving seat is provided with locking means 42 preferably comprising first and second opposed flexible ears extending respectively from leg portions 34*a*, 34*b*; 36*a*, 36*b*; 38*a*, 38*b*; and 40*a*, 40*b* of the seats of torque arms 12, 14 in a direction toward each other and into each rung receiving seat opening with their distal free end portions being spaced from one another a distance less than the width of a ladder rung. Preferably the ears extend in a direction angled toward the center of the apparatus out of the plane in which the torque arm lies to enhance flexible interlocking with the ladder rungs.

The vertical distance between the locking means 42 of the upper and lower portions is selected to be the same as that of a conventional ladder, i.e., approximately twelve inches. Preferably the distance between the locking means 42 and upper bight portions 34*c*, 36*c* respectively of U-shaped seats 34, 36 is chosen to be slightly greater than the distance between locking means 42 and the bight portions 38*c*, 40*c* respectively of the lower U-shaped seats 38, 40 so that bight portions 38*c*, 40*c* of the lower portions of the torque arms will fully seat on a rung to promote stability of the platform.

Preferably, a stop member 48, 50 respectively extends rearwardly from each torque arm intermediate the upper and lower terminus portions to serve as a stop surface when the attachment apparatus is dislodged from the locked position. That is, if a force is applied to unlock the apparatus from the locking means 42 motion of the apparatus will be arrested by the upper generally horizontal surface of members 48, 50 respectively engaging the upper rung thereby limiting the motion of the apparatus in a controlled manner.

Figure 3:
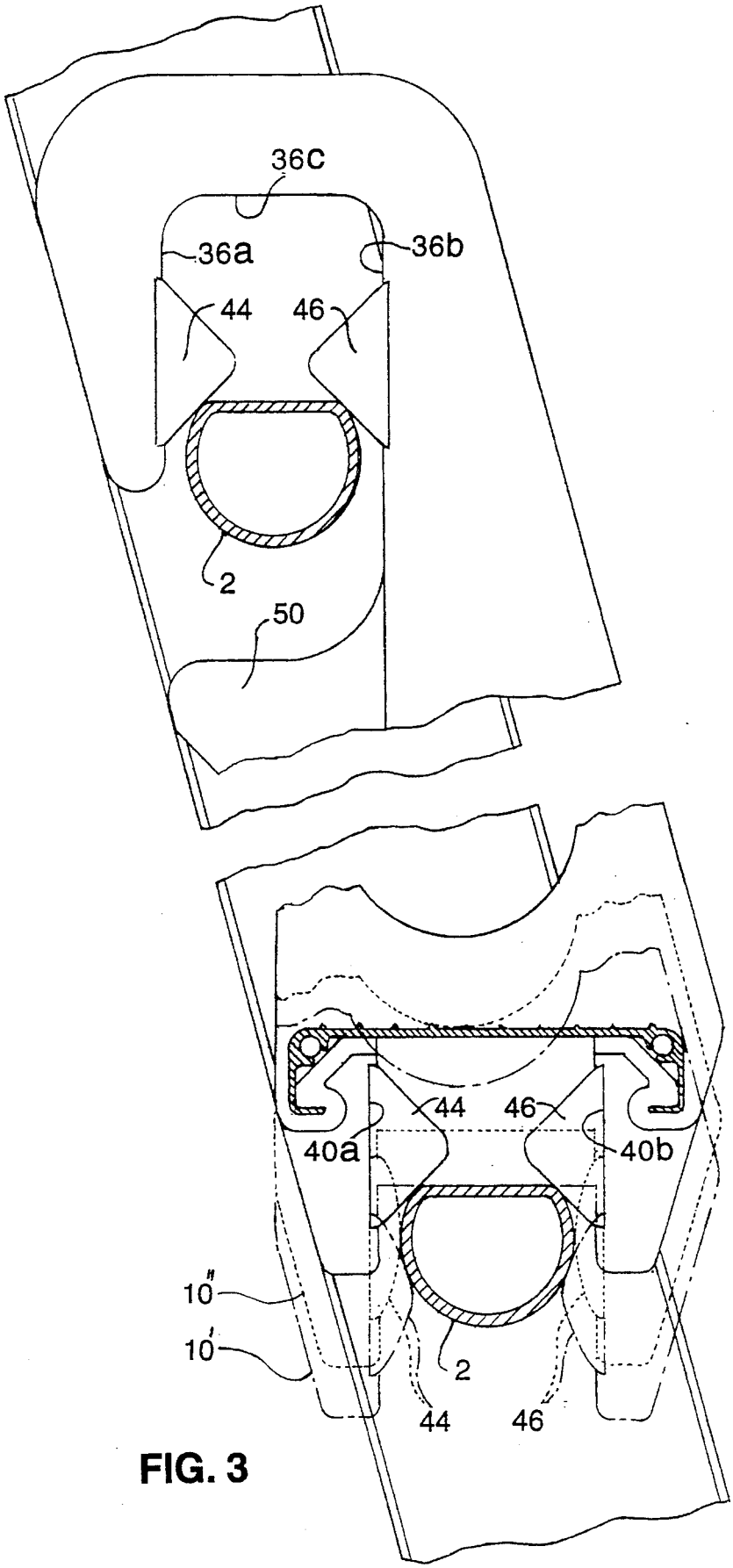
FIG. 3 is a side elevational cross-sectional view of the FIG. 1 attachment apparatus and ladder with the central portion of the apparatus and ladder broken away and showing the lower portion of the platform attachment apparatus in several steps of being seated on a ladder rung.

Securely attaching the safety platform attachment apparatus 10 to the rungs of a ladder is easily accomplished without the use of any tools by positioning the apparatus on the rungs 2 of a ladder as shown in solid lines in FIG. 3 so that the apparatus is supported on the rungs by locking means 42. While in that position the apparatus is smartly pushed downwardly by hand or foot to properly and securely attach the apparatus to the ladder as shown in FIG. 1 and in dashed lines 10' in the lower portion of FIG. 3. Also shown in FIG. 3 is an intermediate position shown in dashed lines 10". It will be noted that in the solid line position ears 44, 46 are full extended and are pushed inwardly in the intermediate position to allow the rung to pass by the ears and are still pushed in partially in the fully seated position.

Figure 4:
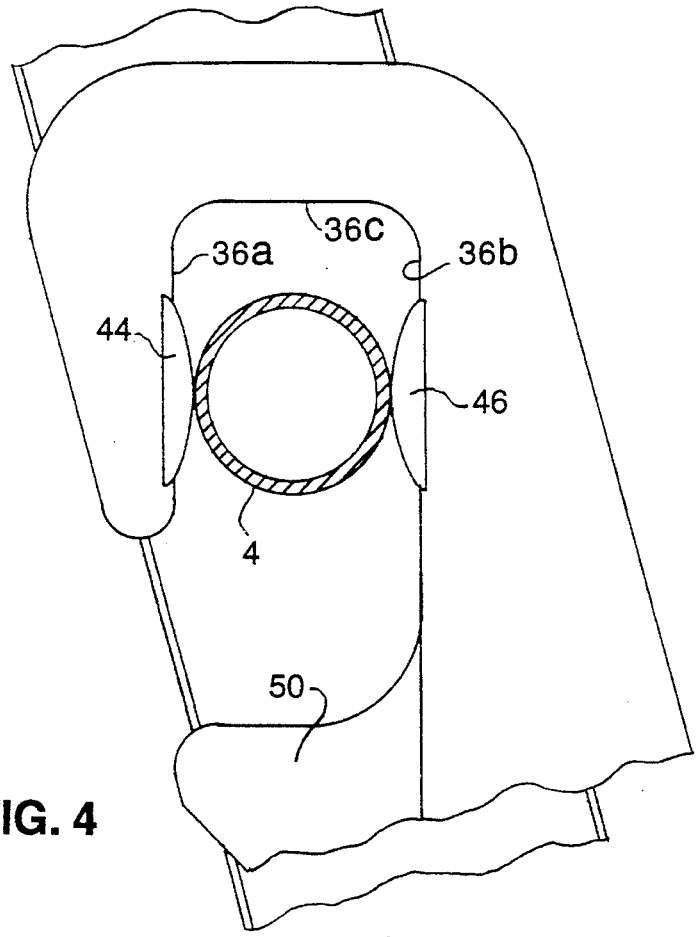
FIG. 4 is a view similar to the top portion of FIG. 3 showing the top portion of the attachment apparatus used with a rung having a circular cross-section and shown in an intermediate seating position.
Figure 5:
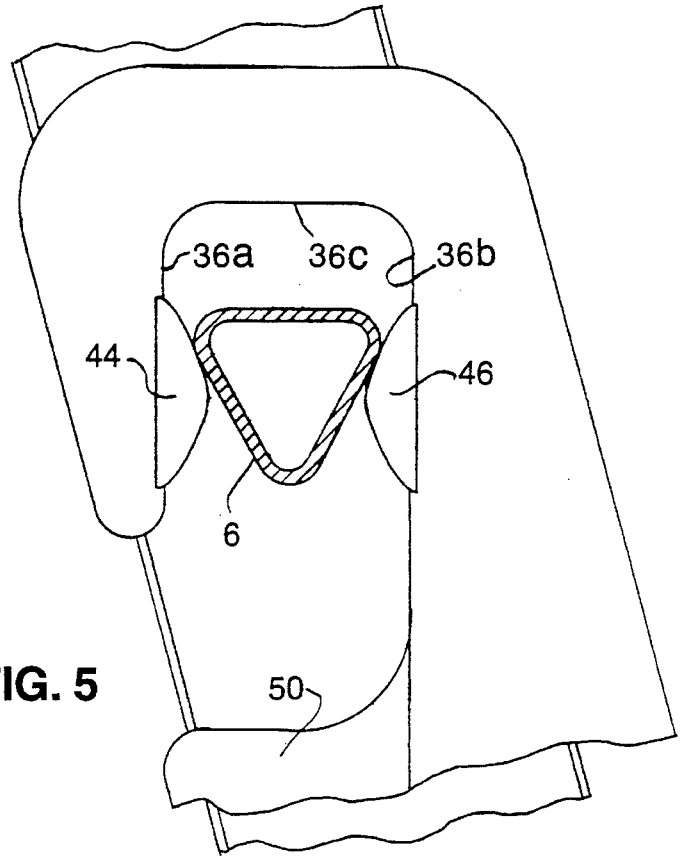
FIG. 5 is a view similar to FIG. 4 in which the apparatus is used with a rung having a generally triangular cross-section and shown in the fully seated position.

FIGS. 4 and 5 show the apparatus used with other rung configurations such as a circular configuration of rung 4 in FIG. 4 shown in the intermediate seated position and triangular configuration of rung 6 shown in the fully seated position in FIG. 5.

Torque arms 12, 14 may be provided with ribbed apertures 12*a*, 12*b*, 12*c* and 14*a*, 14*b*, 14*c* respectively, as desired, to rigidify the arms as well as to decrease the weight of the apparatus.

While the invention has been described with reference to a preferred illustrative embodiment, this description is not intended to be construed in a limiting sense. Various modifications and combinations will be apparent to a person skilled in the art upon reference to the description. For example, if desired, the locking means can be formed from separate component parts. Further, the apparatus can be formed integrally or of separate components of any suitable material such as metal, wood or polymer. As shown, the platform is formed of a metallic extrusion and the torque arms are formed of injection molded polypropylene both of which are cost effective and have excellent strength. It is therefore the intention that the appended claims encompass any such modifications or embodiments.

What is claimed:

1. A safety platform attachment apparatus for use with ladders having a plurality of rungs spaced a selected distance from one another comprising first and second torque arms each having an upper and a lower terminus portion and having a platform fixedly attached and extending between the arms, ladder rung receiving seats formed at the upper and lower terminus portions of each torque arm, the seats having opposite sides and opening in a downward direction, locking means comprising first and second flexible ears extending from the opposite sides of each respective seat toward one another, the ears extending out of a plane in which a respective torque arm lies in a direction toward the other torque arm, the locking means of the upper terminus portion spaced from the locking means of the lower terminus portion a distance essentially equal to the selected distance.

2. Safety platform attachment apparatus according to claim 1 in which the ears are formed integrally with the respective torque arms.

3. Safety platform attachment apparatus according to claim 1 in which each ladder rung receiving seat is generally U-shaped having first and second legs forming the said opposite sides with a bight portion therebetween and the locking means of the lower ladder rung receiving seats being spaced closer to their respective bight portions than the locking means of the upper ladder rung receiving seats are spaced from their respective bight portions.

4. Safety platform attachment apparatus according to claim 1 including a stop surface extending rearwardly from at least one torque arm intermediate the upper and lower ladder rung receiving seats.

5. Safety platform attachment apparatus according to claim 1 in which the platform is generally rectangular having generally straight front and rear longitudinally extending edges each having a downwardly extending wall portion to reinforce the platform.

6. Safety platform attachment apparatus according to claim 1 wherein the platform is attached to the torque arms adjacent the lower terminus portions thereof.

7. Safety platform attachment apparatus according to claim 1 in which the ears have a free outer distal end portion, the end portions of the ears of each respective locking means spaced from one another a distance less than the thickness of a rung of a standard ladder.

8. A safety platform attachment apparatus for use with ladders having a plurality of rungs spaced a selected distance from one another comprising first and second torque arms each having an upper and a lower terminus portion and having a platform fixedly attached and extending between the lower terminus portions of the arms, ladder rung receiving seats formed at the upper and lower terminus portions of each torque arm, the seats having opposite sides and opening in a downward direction, locking means comprising first and second flexible ears extending from the opposite sides of a respective seat toward one another and out of a plane in which the respective torque arm lies in a direction toward the other torque arm, and the locking means of the upper terminus portion spaced from the locking means of the lower terminus portion a distance essentially equal to the selected distance.

9. Safety platform attachment apparatus according to claim 8 in which each ladder rung receiving seat is generally U-shaped having first and second legs forming the said sides with a bight portion therebetween and the locking means of the lower ladder rung receiving seats are spaced closer to their respective bight portions than the locking means of the upper ladder rung receiving seats are spaced from their respective bight portions.

10. A safety platform attachment apparatus for use with ladders having a plurality of rungs spaced a selected distance from one another comprising first and second torque arms each having an upper and a lower terminus portion and having a platform fixedly attached and extending between the arms, ladder rung receiving seats formed at the upper and lower terminus portions of each torque arm, the seats having opposite sides and opening in a downward direction, each ladder rung receiving seat being generally U-shaped having first and second legs forming the said opposite sides with a bight portion therebetween and locking means comprising first and second flexible ears extending from the opposite sides of a respective seat toward one another, the locking means of the upper terminus portion spaced from the locking means of the lower terminus portion a distance essentially equal to the selected distance and the locking means of the lower ladder rung receiving seats being spaced closer to their respective bight portions than the locking means of the upper ladder rung receiving seats are spaced from their respective bight portions, wherein said ears are formed integrally with the respective torque arms.

11. Safety platform attachment apparatus according to claim 10 in which the ears extend out of a plane in which a respective torque arm lies in a direction toward the other torque arm.

12. Safety platform attachment apparatus according to claim 10 including a stop surface extending rearwardly from at least one torque arm intermediate the upper and lower ladder rung receiving seats.

13. Safety platform attachment apparatus according to claim 10 in which the platform is generally rectangular having generally straight front and rear longitudinally extending edges each having a downwardly extending wall portion to reinforce the platform.

14. Safety platform attachment apparatus according to claim 10 wherein the platform is attached to the torque arms adjacent the lower terminus portions thereof.

15. Safety platform attachment apparatus according to claim 10 in which the ears have a free outer distal end portion, the end portions of the ears of each respective locking means spaced from one another a distance less than the thickness of a rung of a standard ladder.

* * * * *